US009010592B1

(12) United States Patent
Toon, Jr.

(10) Patent No.: US 9,010,592 B1
(45) Date of Patent: Apr. 21, 2015

(54) WRIST-MOUNTED HANDKERCHIEF HOLDING DEVICE

(71) Applicant: James W. Toon, Jr., Great Mills, MD (US)

(72) Inventor: James W. Toon, Jr., Great Mills, MD (US)

( * ) Notice: Subject to any disclaimer, the term of this patent is extended or adjusted under 35 U.S.C. 154(b) by 244 days.

(21) Appl. No.: 13/798,240

(22) Filed: Mar. 13, 2013

(51) Int. Cl.
*A44C 5/18* (2006.01)
*A45F 5/00* (2006.01)

(52) U.S. Cl.
CPC ..... *A45F 5/00* (2013.01)

(58) Field of Classification Search
USPC ..... 224/576, 162, 218–221, 254, 165; 24/3.13; 15/208, 209.1
See application file for complete search history.

(56) References Cited

U.S. PATENT DOCUMENTS

| | | | | |
|---|---|---|---|---|
| 705,196 | A | 7/1902 | Bergmann | |
| 1,461,250 | A | 7/1923 | McKenzie | |
| 1,772,228 | A | 8/1930 | Rochester | |
| 1,982,248 | A * | 11/1934 | Gebhardt | 132/296 |
| D102,338 | S | 12/1936 | Schwab | |
| 2,121,561 | A * | 6/1938 | English | 150/106 |
| 2,204,947 | A | 6/1940 | Apfelbaum | |
| 2,233,157 | A * | 2/1941 | Cahn et al. | 206/361 |
| 2,482,584 | A * | 9/1949 | Harris et al. | 63/1.14 |
| 3,647,059 | A * | 3/1972 | Humphreys | 242/564 |
| 6,131,209 | A * | 10/2000 | Thayer et al. | 2/452 |
| 6,881,273 | B1 * | 4/2005 | Oberman | 134/6 |
| 8,060,969 | B2 * | 11/2011 | Jones | 15/105 |
| 2002/0000455 | A1 * | 1/2002 | Condliff et al. | 224/162 |
| 2007/0157354 | A1 | 7/2007 | Lee | |
| 2009/0266861 | A1 * | 10/2009 | Helmer | 224/584 |

* cited by examiner

*Primary Examiner* — Brian D Nash
*Assistant Examiner* — Corey Skurdal
(74) *Attorney, Agent, or Firm* — Robert C. Montgomery; Montgomery Patent & Design LP

(57) ABSTRACT

A decorative handkerchief deploying device comprises a wrist strap, a handkerchief assembly, and a spring retraction mechanism. The wrist strap is designed to be worn around a user's wrist. The handkerchief assembly is made of an absorbent material and is intended to be used primarily to control sneezes or coughs. In use, the user grasps a knob portion of the handkerchief and extends the handkerchief outwardly. The spring retraction mechanism allows the handkerchief assembly to be retracted back into a "ready" position on the bracelet.

16 Claims, 4 Drawing Sheets

WRIST-MOUNTED HANDKERCHIEF HOLDING DEVICE

RELATED APPLICATIONS

There are no current co-pending applications.

FIELD OF THE INVENTION

The present invention relates to a handkerchief deploying device adjustably mounted to a wrist area of a user.

BACKGROUND OF THE INVENTION

A handkerchief is a well-known tool used not only for wiping and blowing one's nose, but also for helping to control sneezes and coughs, thus preventing the spread of germs. However, sneezes and coughs often come along in an almost instantaneous manner, often leaving one with inadequate time to locate and position the handkerchief for effective use. This is because handkerchiefs are normally stowed in pockets, purses, desk drawers, and the like.

It is desirable to have the handkerchief neatly stowed while not in use, but it is helpful to be stowed in a more salutary manner. It is counter-productive to be forced to stow the handkerchief in a non-readily accessible location such as a pocket or a purse. Preferably, the handkerchief should be stowed near the user's hands for quick access. Even more beneficial would be a device to quickly deploy the handkerchief in a ready position when needed and to neatly store the handkerchief when not in use. Preferably, such a device would be decorative and even aesthetically enhancing.

U.S. Pat. No. 2007/0157354 shows a hand-worn device that holds a tissue on a rear portion of the user's hand.

U.S. Pat. No. 1,982,248 shows a handkerchief carrying vanity that is decorative and holds a handkerchief in a readily-available manner. This device, however, does not stow the handkerchief in a neat and aesthetic fashion. Although the manner in which the handkerchief is stowed is more readily accessible than having the handkerchief stowed in one's pocket or purse, the device does not adequately deploy and position the handkerchief for immediate use.

The present invention affords a user the ability to stow and deploy a handkerchief in a quick, convenient, and aesthetic manner. U.S. Pat. App. Pub. No. 2007/0157354 holds a tissue on a rear portion of a user's hand and is readily available, but it is neither aesthetic nor does it stow the tissue in a compact or convenient manner. U.S. Pat. No. 1,982,248 carries a handkerchief in an aesthetic manner but it fails to deploy and position the handkerchief as does the present invention.

SUMMARY OF THE INVENTION

The present invention relates to a wrist-mounted handkerchief deploying device. The device comprises of a wrist strap made of a flexible material and a ball fastener affixed at one (1) end of the wrist strap, a handkerchief, a recoil assembly, a cover, and a plastic stiffener. The ball fastener is removably fastened to one (1) of a plurality of strap apertures that are arranged upon an end of the wrist strap that is opposite to an end of the ball faster. A recoiling assembly is affixed to a top center surface of the wrist strap. A rectangular-shaped handkerchief, made of absorbent textile material, is housed within the recoiling assembly. The recoiling assembly is equipped with an aperture portion through which the handkerchief extends, and it is further equipped with a means for recoiling and locking the handkerchief to desired lengths. A cover comprising of decorative fabric is situated such as to conceal and protect the recoiling assembly. A plastic stiffener is affixed along a leading edge portion of the handkerchief, and is provided with a centrally-located knob that abuts the recoiling aperture portion while the handkerchief is in a full recoil position.

The handkerchief deploying device is wrapped around the user's wrist such that the stiffener is situated to be most proximate to user's hand. The device is worn like a wristwatch or a bracelet. The wrist strap is adjusted and fastened to a desired length and comfort with the use of the ball fastener and the plurality of strap apertures. Grasping and pulling the knob of the stiffener outwardly, the user extends the handkerchief to a desired length. The user allows the locking mechanism of the recoiling assembly to hold the handkerchief at the desired length so the handkerchief can be employed. Tugging on the knob to disengage the locking mechanism allows the recoiling mechanism to retract the handkerchief back into the recoiling assembly.

While in the recoiled position, the device resembles a decorative wrist band. The cover is aesthetic and enhances the user's look. The utility of the invention is affording a means to quickly access and position a handkerchief for effective use while neatly stowing the handkerchief in a decorative and attractive manner. Users do not have the luxury of time in finding handkerchiefs in pockets, purses, desk drawers, or the like. Accordingly, there exists a need for a means by which the features and benefits of a handkerchief can be made almost instantaneously available.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
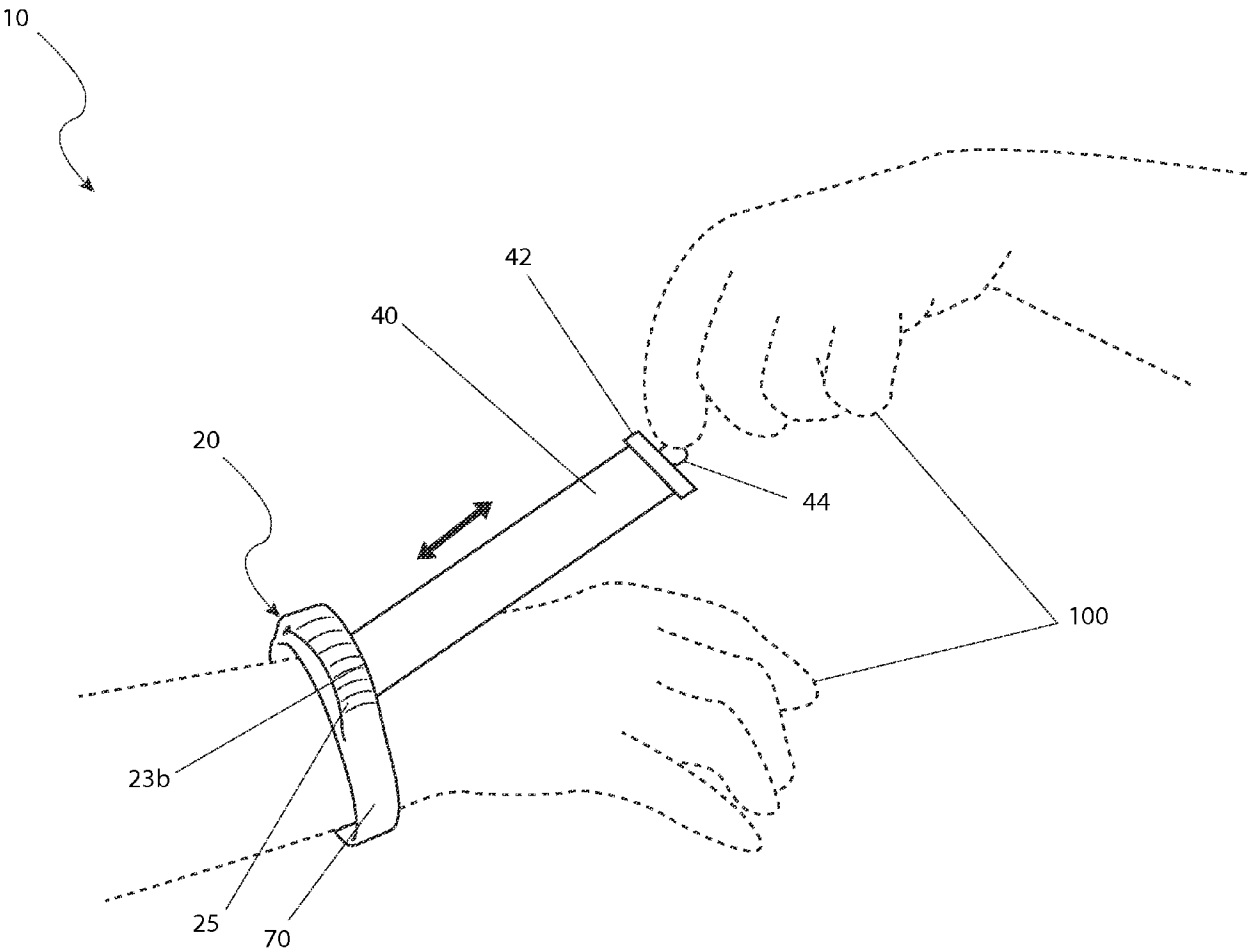
FIG. 1 is an environmental view of a wrist-mounted handkerchief holding device 10 depicting an in-use state, according to a preferred embodiment of the present invention.

10 wrist-mounted handkerchief holding device
20 recoil assembly
22 housing
23*a* first handkerchief aperture
23*b* second handkerchief aperture
24 spool
25 cover
26 hub
28 axle
29 star gear
30 spring
32 locking mechanism
40 handkerchief
42 stiffener
44 knob

70 wrist strap
72 ball fastener
74 strap aperture
80 fastener
100 user

DETAILED DESCRIPTION OF THE PREFERRED EMBODIMENT

Figure 2A:
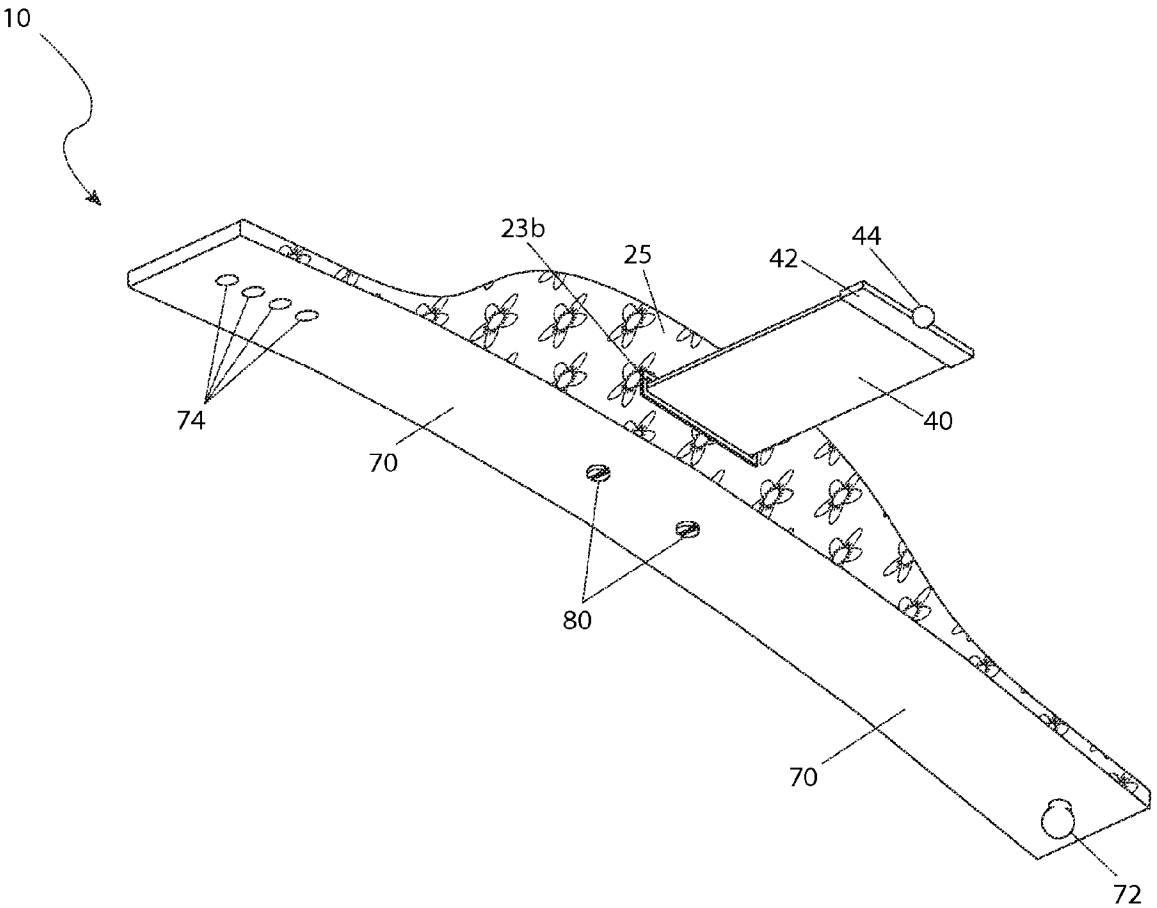
FIG. 2*a* is a perspective view of the wrist-mounted handkerchief holding device 10, according to a preferred embodiment of the present invention.
Figure 2B:
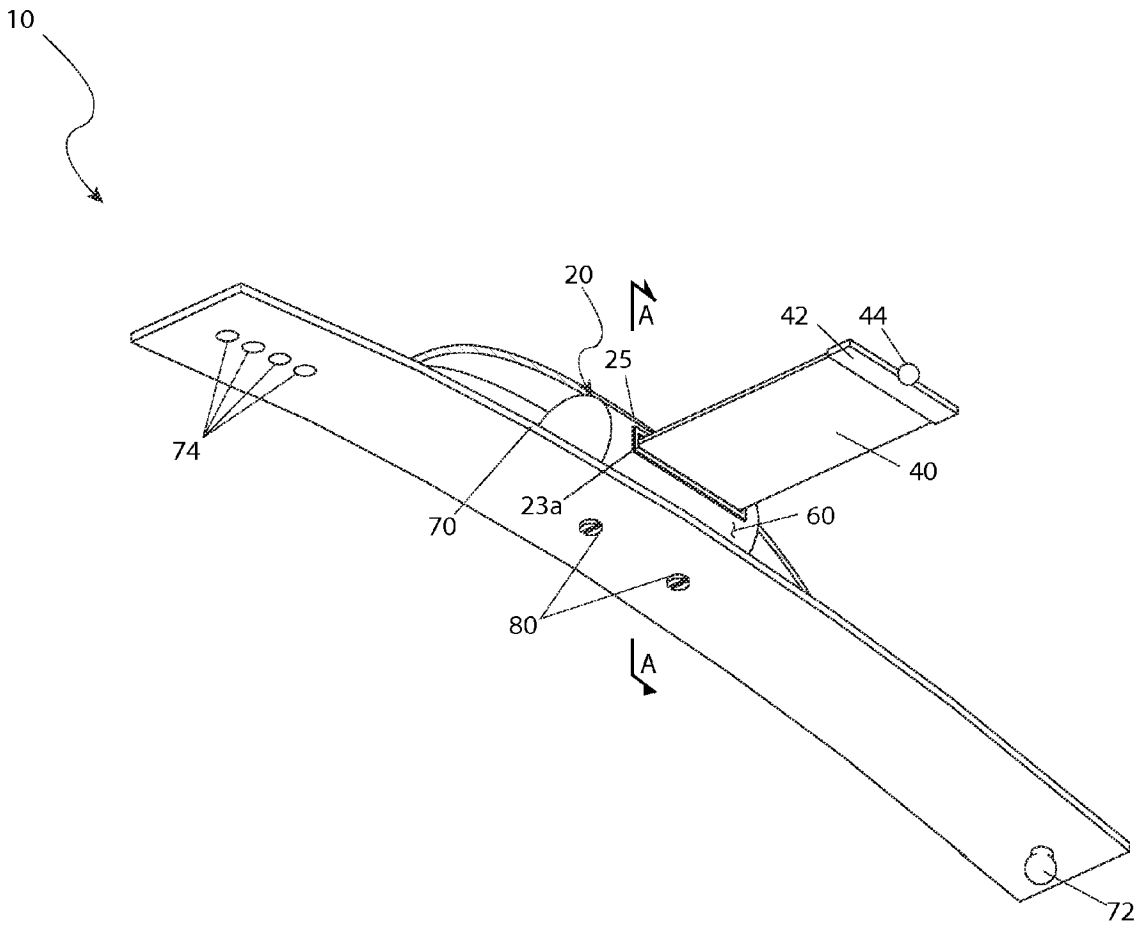
FIG. 2*b* is a cut-away perspective view of the wrist-mounted handkerchief holding device 10, according to a preferred embodiment of the present invention; and, FIG. 3 is a section view of the wrist-mounted handkerchief holding device 10 taken along section line A-A (see FIG. 2*b*), according to a preferred embodiment of the present invention.
Figure 3:
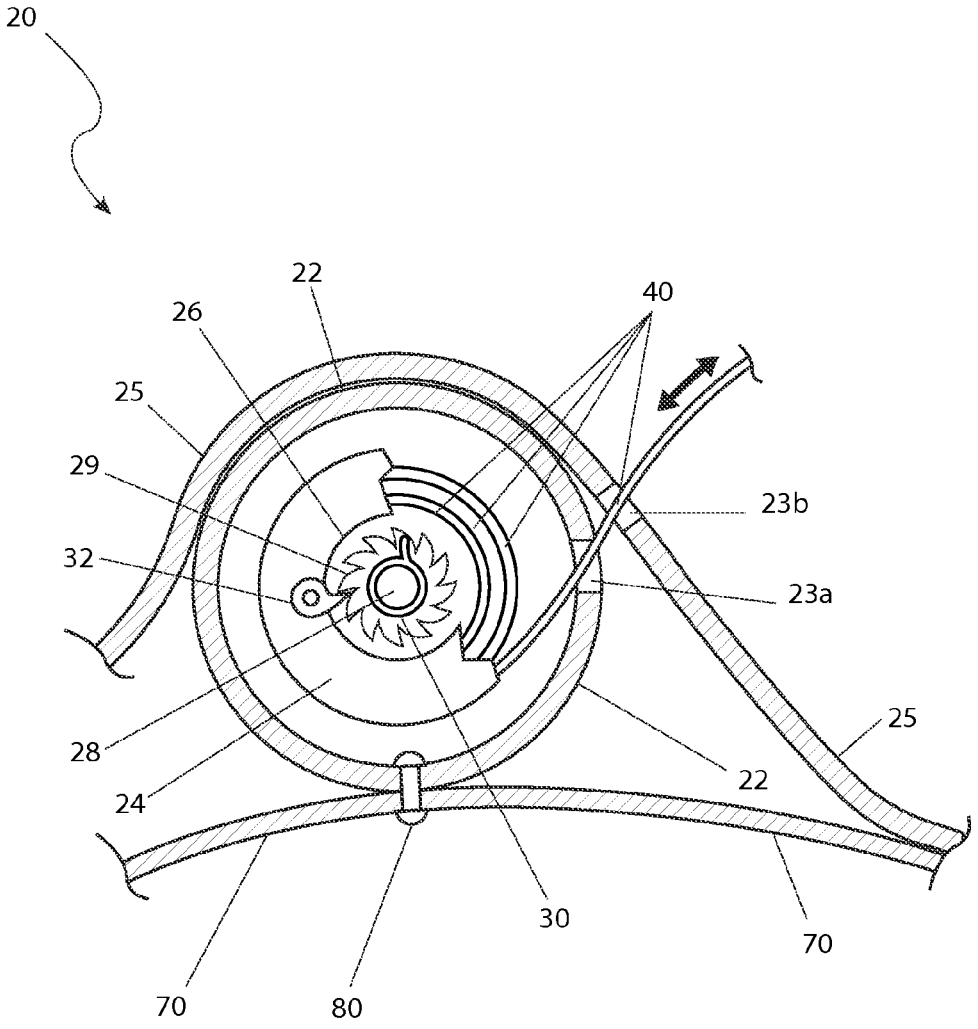

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a wrist-mounted handkerchief holding device (herein described as the "device") 10, which provides a means for a handkerchief deploying assembly being readily available for use primarily helping to control sneezes and coughs and preventing the spread of germs.

Referring now to FIG. 1, an environmental view of the device 10, depicting an in-use state, according to a preferred embodiment of the present invention, is disclosed. The device 10 provides a means for controlling sneezes and coughs, also wiping a user's 100 nose when necessary. The device 10 is attached to the user's wrist area having a deployable handkerchief portion 40 being attached to a recoil assembly 20. It is envisioned that the device 10 will be made available having an integral fabric cover 25 providing multiple colors and designs to suit all users 100. The use of the device 100 allows a user 100 to utilize the anti-germ spreading performance of a handkerchief while providing a means of deployment within a very short time period.

Referring now to FIGS. 2*a* and 2*b*, perspective views of the device 10, according to a preferred embodiment of the present invention, are disclosed. The device 10 comprises a wrist strap 70, a recoil assembly portion 20, a cover 25, and a handkerchief 40. The device 10 is attached to the user's wrist area by the flexible wrist strap 70 envisioned being made of flexible leather-like plastic banding. The wrist strap 70 provides a length adjustment means via a stationary ball fastener 72 permanently affixed at one (1) end and removably fastened to one (1) of a plurality of strap apertures 74 being arranged upon an opposing end of the wrist strap 70 in a linear and equally-spaced manner. The wrist strap 70 further comprises an integrated fabric cover portion 25. The cover 25 is preferably adhesively attached, or otherwise affixed, to an upper surface of said wrist strap 70, thereby covering the recoil device 20 to provide a decorative and aesthetic appearance (see FIG. 1).

The recoil assembly 20 is affixed to a top center surface of the wrist strap 70 via fasteners 80 such as rivets, and further comprises an internal spring-loaded recoiling spool 24 which retracts and stores the handkerchief portion 40 when not in use, and provides an extending and locking means when the handkerchief 40 is needed (see FIG. 3).

The handkerchief 40 is envisioned to be made using an absorbent textile material comprising a rectangular shape and envisioned to be approximately three inches (3 in.) in width and six inches (6 in.) in length when fully deployed; however, the device 10 and the handkerchief 40 are envisioned to be introduced in different length and width sizes such as large, medium, and small, and as such should not be interpreted as a limiting factor of the device 10. The handkerchief 40 further comprises a rectangular plastic stiffener portion 42 being permanently affixed along a leading edge portion of the handkerchief 40 being located in an easily accessed positioned upon a side surface of the recoil assembly 20. The stiffener 42 further comprises a centrally-located integral knob portion 44. In use, a user 100 grasps the knob portion 44 with a free hand, and extends the handkerchief 40 outwardly, passing through a first handkerchief aperture portion 23*a* of the recoil assembly 20 and a second handkerchief aperture portion 26*b* of the cover 25. When finished using the handkerchief 40, it may be locked in the extended position or retracted back into the recoil assembly 20 by applying a tugging motion in a similar manner as a conventional window shade device.

The recoil assembly 20 is discreetly contained within the decorative textile cover 25 for aesthetic purposes and is envisioned to be introduced in various textile types, colors, and patterns based upon a user's 100 preference.

Referring now to FIG. 3, a section view of the device 10 taken along section line A-A (see FIG. 2*b*), according to a preferred embodiment of the present invention, is disclosed. The recoil assembly 20 provides a means to withdraw and wind the handkerchief 40 within the device 10 in a compact manner. The recoil assembly 20 provides a recoiling and locking mechanism comprising a plurality of internal parts including a spool 24, a star gear 29, and a locking mechanism 32. The spool 24 rotates upon an axle 28 while being acted upon by a torsion spring 30 to provide a means to gather and wind up the handkerchief 40. A hub portion 26 of the recoil assembly 20 provides an axial-mounting means to the spring 30 and the star gear 29. The spool 24 rotates via the torsion spring 30 to wind up the handkerchief 40. Said spool 24 rotates upon stationary axle 28 and hub 26 portions. The hub 26 comprises an integral star gear 29 which is engaged by a locking mechanism 32 mounted upon the spool 24 which arrests the rotary motion of the spool 24, thereby retaining the handkerchief 40 in an extended state.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: procuring a model of the device 10 having desired color and patterns upon the handkerchief 40, cover 25, and wrist strap 70 portions; wrapping the wrist strap 70 around a user's 100 wrist such that the handkerchief 40 may extend toward a hand portion of the user 100; wearing the device 10 until needed; grasping and pulling the knob 44 outwardly to extend the handkerchief 40 to a desired extended length; allowing the recoil assembly 20 to maintain the handkerchief 40 in the extended state; using the handkerchief 40 to help control a sneeze or cough, or even wipe a user's 100 nose if necessary; returning the handkerchief 40 to the retracted state by applying a slight tug upon the knob 44 to allow the recoil assembly 20 to wind up the handkerchief 40; using the device 10 repeatedly as needed; and, benefiting from a readily accessible wrist-mounted means to control a sneeze, cough, or the like, afforded a user 100 of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A handkerchief holding device, comprising:

a strap, further having an adjustment means for adjusting a length of strap;

a recoil assembly affixed to an upper surface of said strap, having a first aperture;

a handkerchief attached to said recoil assembly and operably controlled thereby; and, a cover affixed to an upper surface of said strap, further having a second aperture aligned with said first aperture;

wherein said adjustable strap is configured for removable and adjustable attachment to a wrist area of a user;

wherein said recoil assembly enables deployment of said handkerchief through said first aperture and said second aperture and secures said handkerchief in a desired extended state; and, wherein said cover covers said strap and recoil assembly.

2. The device of claim 1, wherein said recoil assembly further comprises:

a recoiling spool freely rotating about an axle, further comprising a hub portion, a torsion spring mounted to said hub, and a star gear mounted to said hub; and, a locking mechanism mounted upon said spool and in mechanical communication with said star gear;

wherein an internal edge of said handkerchief is attached to said recoiling spool;

wherein said torsion spring biases said recoiling spool to wind said handkerchief in a fully retracted state;

wherein a leading edge of said handkerchief extends at least partially outward of said first aperture and said second aperture;

wherein a pulling force on said handkerchief advances said handkerchief outward;

wherein said handkerchief is secured in said desired extended state when said locking mechanism engages said star gear; and, wherein said handkerchief is released from said extended position by applying an additional pulling force to said handkerchief.

3. The device of claim 2, wherein said adjustable strap is flexible.

4. The device of claim 3, wherein said adjustable strap comprises plastic banding.

5. The device of claim 3, wherein said adjustment means further comprises a stationary ball fastener affixed at a first end of said strap removably fastened to a desired one of a plurality of strap apertures located adjacent to an opposing second end of said strap.

6. The device of claim 2, wherein said handkerchief comprises an absorbent textile material having a rectangular shape.

7. The device of claim 2, wherein said handkerchief further comprises a plastic stiffener portion having a knob affixed along said leading edge portion.

8. The device of claim 7, wherein said handkerchief further comprises approximately three inches in width and six inches in length when in a fully extended state.

9. A handkerchief holding device, comprising:

a strap, further having an adjustment means for adjusting a length of strap;

a recoil assembly affixed to an upper surface of said strap, having a first aperture;

a handkerchief attached to said recoil assembly and operably controlled thereby; and, a removable cover, further having a second aperture;

wherein said cover is configured to be placed on said upper surface of said strap such that said second aperture is aligned with said first aperture and covers said strap and said recoil assembly;

wherein said adjustable strap is configured for removable and adjustable attachment to a wrist area of a user; and, wherein said recoil assembly enables deployment of said handkerchief through said first aperture and said second aperture and secures said handkerchief in a desired extended state.

10. The device of claim 9, wherein said recoil assembly further comprises:

a recoiling spool freely rotating about an axle, further comprising a hub portion, a torsion spring mounted to said hub, and a star gear mounted to said hub; and, a locking mechanism mounted upon said spool and in mechanical communication with said star gear;

wherein an internal edge of said handkerchief is attached to said recoiling spool;

wherein said torsion spring biases said recoiling spool to wind said handkerchief in a fully retracted state;

wherein a leading edge of said handkerchief extends at least partially outward of said first aperture and said second aperture;

wherein a pulling force on said handkerchief advances said handkerchief outward;

wherein said handkerchief is secured in said desired extended state when said locking mechanism engages said star gear; and, wherein said handkerchief is released from said extended position by applying an additional pulling force to said handkerchief.

11. The device of claim 10, wherein said adjustable strap is flexible.

12. The device of claim 11, wherein said adjustable strap comprises plastic banding.

13. The device of claim 11, wherein said adjustment means further comprises a stationary ball fastener affixed at a first end of said strap removably fastened to a desired one of a plurality of strap apertures located adjacent to an opposing second end of said strap.

14. The device of claim 10, wherein said handkerchief comprises an absorbent textile material having a rectangular shape.

15. The device of claim 10, wherein said handkerchief further comprises a plastic stiffener portion having a knob affixed along said leading edge portion.

16. The device of claim 15, wherein said handkerchief further comprises approximately three inches in width and six inches in length when in a fully extended state.

* * * * *